US005375296A

United States Patent [19]

Zaleskie

[11] Patent Number: 5,375,296

[45] Date of Patent: Dec. 27, 1994

[54] ADJUSTABLE HINGE AND INSTALLATION METHOD FOR INSET DOORS

[76] Inventor: Walter V. Zaleskie, 206 New Haven Dr., Lititz, Pa. 17543

[21] Appl. No.: 77,647

[22] Filed: Jun. 17, 1993

[51] Int. Cl.[5] ..... E05D 5/02; E05D 7/04

[52] U.S. Cl. ..... 16/237; 16/391; 16/DIG. 29

[58] Field of Search ..... 516/237, DIG. 29; 16/236, 391, 387

[56] References Cited

U.S. PATENT DOCUMENTS

| | | | |
|---|---|---|---|
| 122,088 | 12/1871 | Wells | 16/DIG. 29 |
| 2,615,194 | 10/1952 | Kreiner . | |
| 2,655,686 | 10/1953 | Summergsgill | 16/DIG. 29 |
| 2,885,722 | 5/1959 | Halliday | 16/237 |
| 3,134,133 | 5/1964 | Hilfiker . | |
| 3,526,922 | 9/1970 | Kellems | 16/DIG. 29 |
| 3,908,226 | 9/1975 | Read et al. . | |
| 4,175,315 | 11/1979 | Hayes, Sr. et al. . | |
| 4,237,577 | 12/1980 | Chapel . | |
| 4,543,687 | 10/1985 | Law . | |
| 4,603,452 | 8/1986 | Paciorek . | |
| 4,674,150 | 6/1987 | Salice . | |
| 4,698,877 | 10/1987 | Lautenschlager, Jr. et al. . | |
| 4,720,896 | 1/1988 | Lautenschlager, Jr. et al. . | |
| 4,748,716 | 6/1988 | Bentz et al. . | |
| 5,144,721 | 9/1992 | Schade . | |

FOREIGN PATENT DOCUMENTS

| | | | |
|---|---|---|---|
| 608149 | 11/1980 | Canada | 16/DIG. 29 |
| 1077933 | 8/1967 | United Kingdom | 16/237 |

OTHER PUBLICATIONS

Braun Manufacturing Company, Inc., Miscellaneous, p. 65.

*Primary Examiner*—W. Donald Bray
*Assistant Examiner*—Donald M. Gurley
*Attorney, Agent, or Firm*—Sixbey, Friedman, Leedom & Ferguson

[57] ABSTRACT

A non-mortised door hinge is formed of a large and a small hinge leaf pivotally interconnected about a pivot pin, the smaller leaf being of substantially the same size and shape as a central cut-out in the larger leaf for nesting within the cut-out area of the larger leaf to form a hinge of single leaf thickness. At least one of the upper and lower peripheral edges of the smaller leaf taper away from the corresponding upper and lower margins of the cut out area for increasing the clearance therebetween with increasing distance from the pivot pin. The hinge has horizontally slotted screw holes on one leaf and vertically slotted screw holes on the other leaf. The slotted holes are used to attach the hinge to a door and frame using screws, while permitting subsequent alignment of the door in its frame. At least one round (non-slotted) hole is also provided on each leaf to accept a setting screw. The setting screw is mounted through the hole into the door or frame to permanently fix the desired alignment of the hinge and door assembly after final adjustment of the alignment at the installation site. The smaller leaf has at least one complete circumference tubular portion which closely interfits in vertical alignment with a pair of spaced complete circumference tubular portions on the larger leaf for receiving the pivot pin therethrough and preventing sliding of the second leaf along the pivot pin.

19 Claims, 3 Drawing Sheets

ADJUSTABLE HINGE AND INSTALLATION METHOD FOR INSET DOORS

BACKGROUND OF THE INVENTION

The present invention relates to hinges which permit adjustment of door alignment subsequent to mounting of the hinge, and to a method for installing doors using this hinge.

Inset cabinet doors, which fit flush into the cabinet door opening when closed, present particular assembly problems. It is essential that the opening be rectangular and that the hinges be mounted in perfect alignment to avoid any binding of the door on the cabinet opening during closing. Such binding will damage the finish of the door and cabinet and does not provide the smooth operation expected from fine quality cabinets. Further, because kitchen cabinets are installed at eye level, any uneven gaps resulting from a poorly fitted door are particularly noticeable.

High-quality kitchen and storage cabinets are typically assembled to order in a central plant and shipped to the desired installation site. During assembly in the plant, dimensional locating fixtures are used to construct a rectangular opening, to mortise hinges where required, and to drill holes for mounting the hinges. Inasmuch as the adjustment of the hinge hole locations to provide the desired fit is most critical in cabinets having inset doors, mounting the hinges to provide proper inset door operation requires much time and attention. The product produced at the central plant must be constantly monitored and the hinge locating fixtures continuously adjusted.

The problems of proper hinge adjustment are multiplied when multiple hinges are provided on a single door. For example, large vertical storage cabinets which are popular in new kitchen cabinet installations may have four or more hinges on a single door. Door fits are also affected by movement of the cabinets during shipping and stresses during installation, so that upon installation the doors may not close properly even though they closed smoothly at the factory. Typically, flat butt hinges are employed wherein the leaves of the hinge abut one another in face-to-bee contact when the hinge is closed. These hinges are difficult to locate accurately, require precise measurements and require mortises to be formed in the door and cabinet frame to enable the door to close snugly against the cabinet frame. In general, the fit problems experienced with standard flat mortised hinges are corrected, on site, using shims. Alternatively, experienced cabinet assemblers and installers can sometimes bend the hinges slightly using a screwdriver or other tool to obtain the desired door fit. The hinges must be bent carefully to avoid damaging the cabinet or adversely affecting operation of the hinge, and it requires some considerable skill to fit doors in this manner.

U.S. Pat. Nos. 3,134,133 to Hilfiker, 4,674,150 to Salice, 3,908,226 to Read et al., and 4,698,877 and 4,720,896 to Lautenschlager, Jr. et al. show adjustable hinges having multiple components. U.S. Pat. Nos. 2,615,194 to Kreiner and 5,144,721 to Schade disclose adjustable hinge assemblies which employ backing plates and slots in either the hinge leaves or the backing plate to permit vertical and horizontal adjustment of the position of the hinge on the door or frame to assure a better fit of the door in the frame. Hinges of these general types are more expensive to manufacture than are flat hinges and provide an obtrusive appearance that is undesirable in fine quality cabinetwork. Such adjustable hinges have not been used in high-quality inset door cabinet applications because of their cost, complexity and appearance. Long, generally flat mortised hinges with adjusting slots in the leaves are available, as illustrated on page 65 of Catalog 155 from Braun Manufacturing Co., Chicago, Ill. However, none of these hinges is entirely suitable for the cabinet applications discussed above.

Another important application of the present invention is in the field of passage and entry door hinges. Wooden passage doors are generally hung on site, inset into a frame with their hinges mortised into both the frame and the door. Solid core wooden doors are heavy and often have three or four hinges. Mortising and mounting multiple hinges properly to both the door and frame so that the door closes flush with the frame and so that neither the door nor the hinge binds requires considerable skill. The doors and frames involved may be of fine hardwood and are costly to replace if ruined through improper hinge placement. As a result, because of the precision required in matching the hinge locations and depths on the door and frame, less-experienced personnel cannot be left to hang heavy doors without supervision if a perfect fit is to be obtained.

A significant improvement in the mounting of both inset cabinet doors as well as passage doors can be realized by use of butt hinges which do not require mortising by virtue of one smaller leaf nesting within a cutout portions of the other larger leaf to present, in the hinge-closed position, a hinge having a single leaf thickness. Such hinges are shown in U.S. Pat. Nos. 4,237,577 to Chapel and 4,543,687 to Law. However, neither of these hinges are readily adjustable in position or capable of achieving long-term stability of the door fit.

SUMMARY OF THE INVENTION

Therefore, it is a general object of the present invention to provide a novel and improved adjustable door hinge.

Another general object of the present invention is to provide a hinge which increases the permissible tolerances for inset door hinge hole locations without reducing the long-term stability of the door fit.

Yet another general object of the present invention is to provide an improved method of installing cabinet hinges to ensure proper fitting of inset doors after installation.

A further general object of the present invention is to provide an inset-door type cabinet incorporating two or more novel and improved adjustable door hinges providing adjustments in two perpendicular planes and having a mechanism for permanently "locking in" the door fit after final adjustment.

It is also an object of the invention to provide a method for installing cabinet doors in which certain hinge screws are installed at a first location remote from the installation site in a way that permits adjustment of the door fit, with additional screws locking in the desired alignment being installed at the actual installation site.

A more specific object of the present invention is to provide a novel and improved adjustable door hinge which has adjustments in two perpendicular planes and has a mechanism for permanently "locking in" the door fit after final adjustment.

Another object of the present invention is to provide a novel and improved adjustable door hinge capable of permanently fixing the desired adjustment, while being no more expensive to manufacture than a conventional hinge.

Yet another object of the present invention is to provide a door hinge having horizontal and vertical elongated slots for receiving mounting screws so that the position of the door can be adjusted after mounting, and also having non-elongated mounting holes near the elongated slots for permanently fixing the position of the hinge when the door has been finally fitted.

These objects and others are achieved by providing a non-mortised door hinge with horizontally slotted screw holes on one leaf and vertically slotted screw holes on the other leaf. The slotted holes are used to attach the hinge to a door and frame using screws, and permit subsequent alignment of the door in its frame. At least one, preferably circular (non-slotted), hole is also provided on each leaf to accept a setting screw. The setting screw is mounted through the circular hole into the door or frame to permanently fix the desired alignment of the hinge and door assembly after final adjustment of the alignment at the installation site. The hinge is particularly useful for inset cabinet doors and for wooden home and office doors.

DETAILED DESCRIPTION OF THE PREFERRED EMBODIMENT

Figure 1:
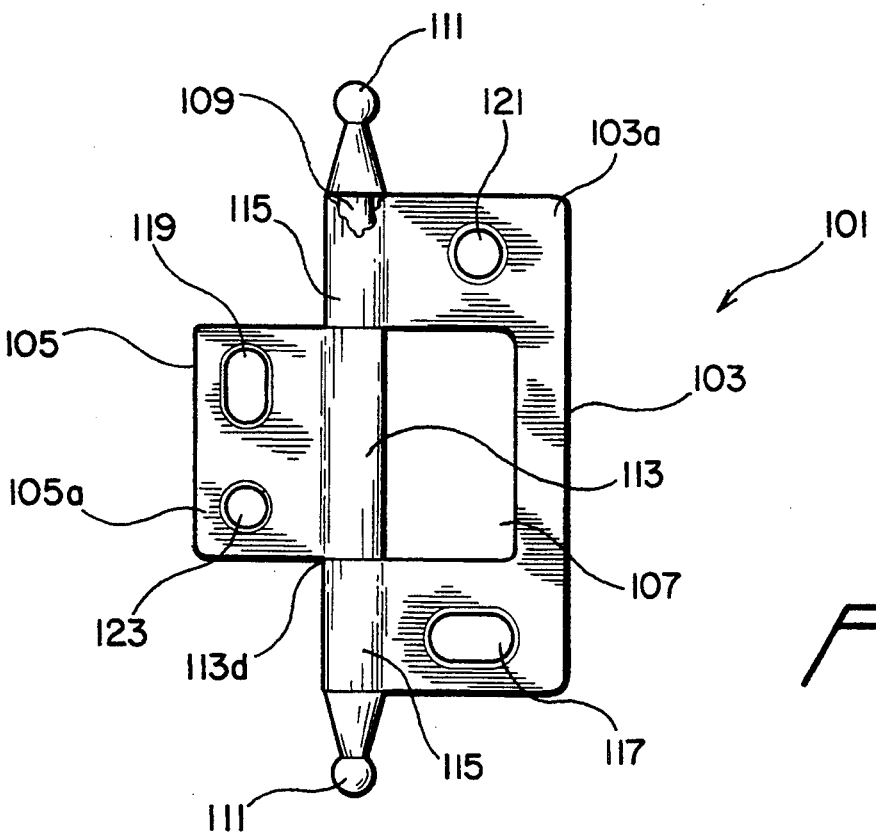
FIG. 1 is an assembly diagram in front elevation of a cabinet hinge according to the present invention.
Figure 2:
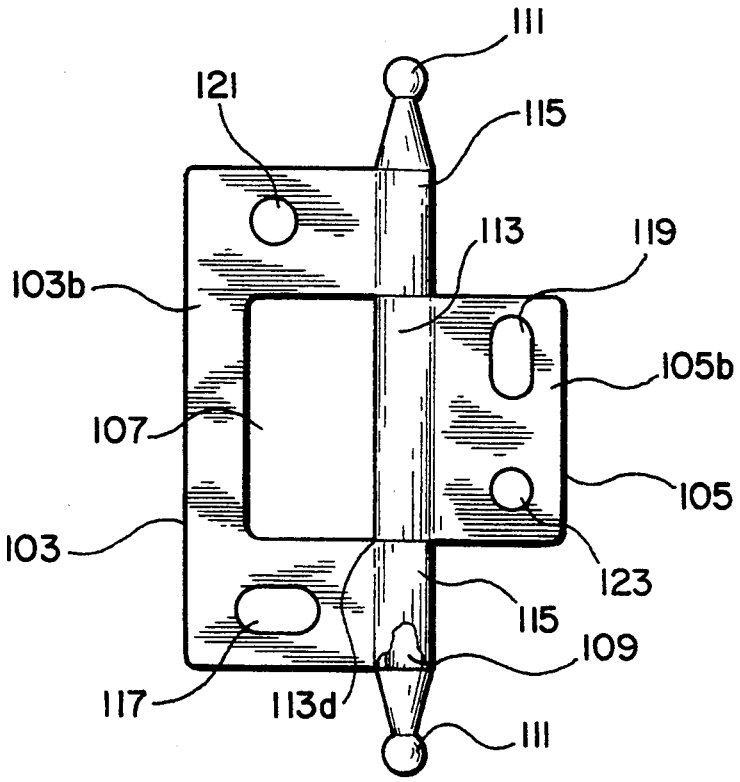
FIG. 2 is an assembly diagram in rear elevation of the hinge of FIG. 1.
Figure 3:
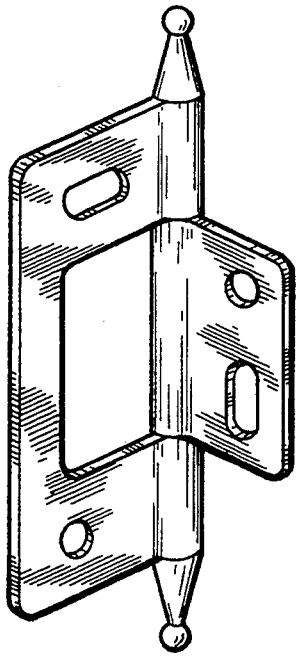
FIG. 3 is a perspective view of the hinge of FIG. 1 in a partially closed position.

Referring to FIG. 1, a cabinet hinge 101 according to the present invention includes a pair of generally rectangular, flat-faced leaves 103, 105 of which the larger 103 is formed with a suitably sized and located central cut-out area 107 within which the smaller leaf 105 can nest. Smaller leaf 105, along a marginal edge, is formed with an integral, generally cylindrical tubular portion or knuckle 113. In like manner larger leaf 103, along a common marginal edge, is formed with two integral generally cylindrical tubular portions 115 spaced apart a sufficient distance that tubular portion 113 can be closely fit therebetween. When the three tubular portions 113, 115 are interfitted, their tubular openings are longitudinally aligned to define a substantially continuous passageway for receiving cylindrical, preferably removably, insertable pivot pin 109 therein about which leaves 103, 105 may pivot with respect to each other in a well-known manner. When smaller leaf 105 pivots about pin 109 to nest within cut-out area 107 of larger leaf 103, the leaves 103, 105 lie in substantially a single plane and form a closed hinge of single leaf thickness.

It is a particular advantage of the present invention that it produces a highly decorative hinge suitable for use with custom cabinets. To this end, the hinge may be provided with decorative finials 111 mounted to the ends of pin 109. For cabinet use, the leaves 103, 105 and the finials 111 may preferably be made from solid brass with a uniform finish as desired. In other, non-decorative uses alternative materials, such as steel, may be preferred. Pivot pin 109 is desirably made of steel, or other metal alloy, for increased strength.

Hinge 101 is designed for non-mortised installation, so that leaf 105 will be surface mounted onto a cabinet door and leaf 103 will be surface mounted within the frame of the cabinet. Alternatively, leaf 103 may be mounted to the cabinet door and leaf 105 mounted to the cabinet frame. Leaves 103 and 105 will be sized for the requirements of the cabinet; typically, leaves 103 and 105 might be $\frac{3}{4}$ inches by 2 inches and about 1/16 inch in thickness. Therefore, the space available for mounting holes will generally be limited and effective use of the space to achieve the desired objective is required.

Leaf 103 is provided with a slot (elongated hole) 117, the longitudinal axis of which is perpendicular to the longitudinal axis of pin 109. Leaf 105 is provided with a slot (elongated hole) 119 the longitudinal axis of which is parallel to the longitudinal axis of pin 109, and thus perpendicular to the longitudinal axis of slot 117. In the embodiment shown, the edges of slots 117 and 119 are beveled from the top surfaces **103*a*, 105*a* to the bottom surfaces 103*b*, 105*b* to form countersunk holes which are particularly adaptable to receive flathead screws. Flathead screws are particularly preferred because the substantial surface contact between the beveled portion of the screw head and the edges of slots 117 and 119 prevents even slight motion of the hinge 101 relative to the flathead screws in the directions perpendicular to the longitudinal axes of slots 117 and 119**.

Each of the leaves 103 and 105 also has a round locking hole, indicated by 121 and 123 respectively. Locking holes 121 and 123 also have beveled edges to receive a flathead screw. Again, flathead screws are particularly preferred for use with locking holes 121 and 123 because the surface contact between the beveled edges of holes 121 and 123 and the beveled underside of the flathead screw around its periphery prevents motion of the hole 121 and 123 (and thus hinge 101) relative to the flathead screw which is fixed to the cabinet or door. Preferably, hinge 101 will be supplied to the user with flathead screws matched in size to the slots 117, 119 and holes 121,123, and having a finish matched to the finish applied to hinge 101.

While locking holes 121 and 123 are preferably round holes, they need not be. To perform the desired locking function, it is important that any elongation of the locking holes 121 and 123 be in a direction other than (such as perpendicular to) the direction of elongation of slots 117, 119 respectively. What is important is that when the locking fastener is connected to the underlying surface through locking hole 121, it substantially prevents adjustment of the position of leaf 103 in the direction of the longitudinal axis of slot 117 (i.e. horizontal) due to the proximity of (and, generally, contact between) the edge of the locking hole 121 and the locking fastener. Similarly, when a locking fastener is connected to the underlying surface through locking hole 123, it must substantially prevent adjustment of the position of leaf 105 in the direction of the longitudinal axis of slot 119 (i.e. vertical) due to the proximity of (and, generally, contact between) the edge of the locking hole 123 and the locking fastener.

Figure 4:
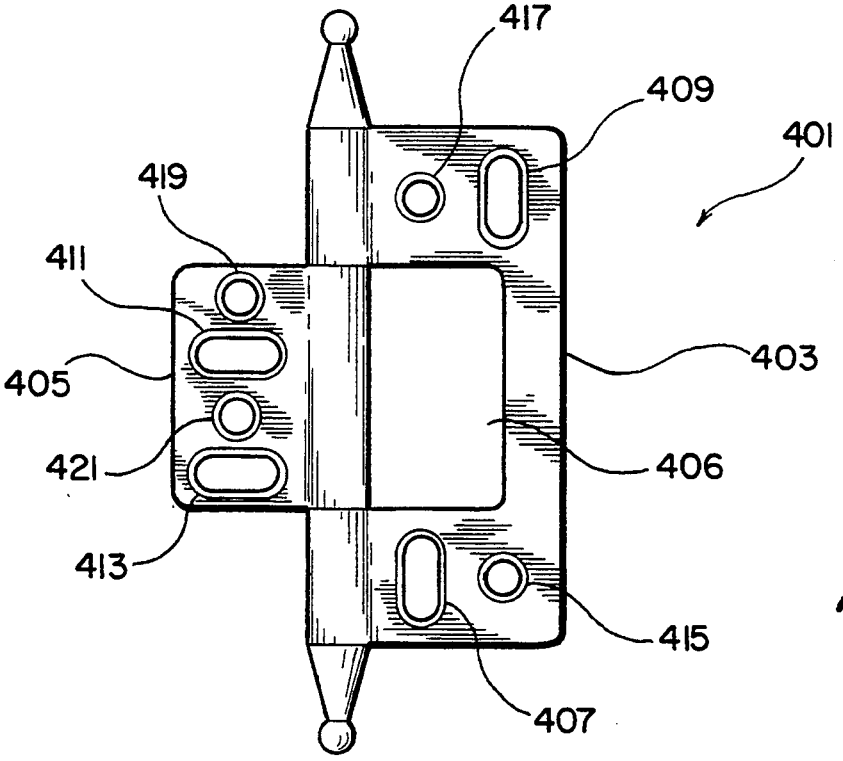
FIG. 4 is an assembly diagram of a hinge according to the present invention which has particular utility for use with interior or entry doors.

FIG. 4 shows an illustrative alternate embodiment of hinge 101 which has particular utility as a passage or entry door hinge 401 constructed with large and small leaves 403 and 405, respectively and with a combination of holes and slots (elongated holes) according to the present invention. Specifically, leaf 403 has vertical slots 407 and 409 and leaf 405 has horizontal slots 411 and 413. Leaf 403 has locking holes 415, 417 and leaf 405 has locking holes 419 and 421. The provision of two locking holes 415, 417 and 419, 421 on each leaf increases the stability of the hinge and prevents any possibility of rotation or slippage of the hinge 401 with respect to the door or frame after screws are installed in all of the slots 407, 409, 411, and 413 and the holes 415, 417, 419, and 421. The slots 407, 409, 411, and 413 and holes 415, 417, 419, and 421 have beveled sides to conform to the shape of flathead mounting screws which are preferably provided with the hinge. Hinge 401 may have a conventional, preferably removable pivot pin (not shown) about which leaves 403 and 405 rotate to permit smaller leaf 405 to nest within cut-out area 406 of larger leaf 403 for forming a closed hinge of substantially single leaf thickness. The pin is desirably removable to facilitate installation and removal of the door.

The positioning of the holes and slots in hinge 401 provides particular utility. In particular, as shown in FIG. 4, vertical slots 407 and 409 have central longitudinal axes which are parallel to and offset from one another. As a result, cant adjustment of the door is possible about two axes rather than about only one axis as in the embodiment of FIG. 1. The positioning of fixing holes 415, 417, 419, 421 located at the center as well as at the top and bottom of hinge 401 provides improved stability of the hinge during alignment of the door.

It will be appreciated that in all embodiments of this invention the positions of slots can be interchanged with the positions of fixing holes and the positions of both slots and fixing holes can be varied. In addition, each leaf may have one or more slots and one or more fixing holes, depending upon the intended application for the hinge. Likewise, either leaf can be formed with the vertical slots (e.g. slots 119 in FIG. 1 and 407, 409 in FIG. 4) or the horizontal slots (e.g., slots 117 in FIG. 1 and 411, 413 in FIG. 4). However, in accordance with the present invention neither leaf may have both horizontal and vertical slots formed therein.

Figure 5:
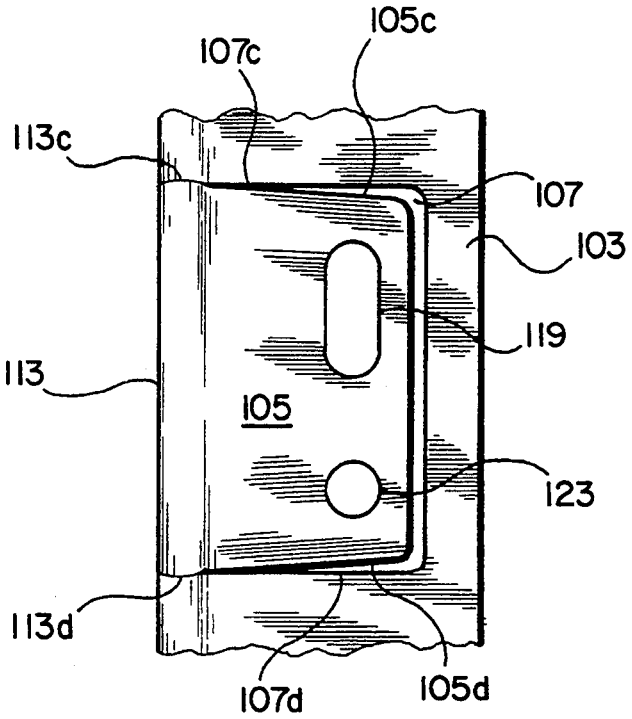
FIG. 5 is a partial assembly diagram of the hinge of FIG. 1 showing one leaf nesting within the other.

Inset cabinet door and inset entry door hinges have in the past not been manufactured to close tolerances. Typically, there has been a loose fit between the knuckles and the pivot pin with the result that there has been considerable slop or play in the hinge which has allowed door sagging and binding between the inset door opening and the perimeter of the doors. In accordance with the present invention the smaller leaf is caused to fit more precisely within the cut-out area of the larger leaf by providing completely tubular knuckles having machined (drilled) tubular openings which closely fit about the outer diameter of the pivot pin. Conventionally, hinge knuckles have been formed by crimping, rolling or turning one marginal edge of each leaf to form a generally cylindrical, substantially tubular knuckle having a crimping slot along its length where the crimped or rolled edge meets itself. Such a knuckle, forming a tube of incomplete circumference, is known as a slotted knuckle. Slotted knuckles are simple and inexpensive to manufacture but are necessarily dimensionally imprecise and fail to provide the close tolerances necessary for assuring a first-class inset door fit with uniform gaps between the door perimeter and the opening. In accordance with the present invention completely tubular knuckles are employed wherein the leaves are extruded as a single blank with an integral solid cylindrical portion having a diameter greater than the diameter of the pivot pin formed along one marginal edge. The tubular knuckle is formed therefrom by drilling the tubular passageway longitudinally through the solid cylindrical portion to the precise tolerances which are available using ordinary metal drilling techniques. In this way, a close fit is assured between the tubular passageway and the pivot pin and there is no slop or play therebetween. In addition, to assure that there is a close inter fit between the upper and lower knuckles on the larger leaf and the single knuckle on the smaller leaf, so that there can be no longitudinal sliding of the smaller leaf along the pivot pin, the smaller leaf and its integral knuckle are desirably machined out of the same solid extruded blank as is used to form the larger leaf. Further, as is shown most clearly in FIG. 5, to prevent binding between the door perimeter and the opening due to the weight of the door, the lower marginal edge **105*d* of leaf 105 is preferably tapered away from the lower margin 107*d* of opening 107 to provide the desired clearance. The taper is such that the lower marginal edge 105*d* tapers continuously from its end adjacent the lower end 113*d* of knuckle 113 so that the clearance between edge 105*d* and lower margin 107*d* increases with increasing distance away from tubular knuckle 113. In a particularly preferred form of the invention, the upper marginal edge 105*c* of leaf 105 also tapers continuously from its end adjacent the upper end 113*c* of knuckle 113 away from the upper margin 107*c* of opening 107 so that the clearance between edge 105*c* and upper margin 107*c* increases with increasing distance away from tubular knuckle 113. Thus, as can be seen most clearly in FIG. 5, in the particularly preferred embodiment, both the upper and lower marginal edges 105*c*, 105*d* taper away from their respective ends of knuckle 113 toward each other with increasing distance from knuckle 113**.

Figure 6:
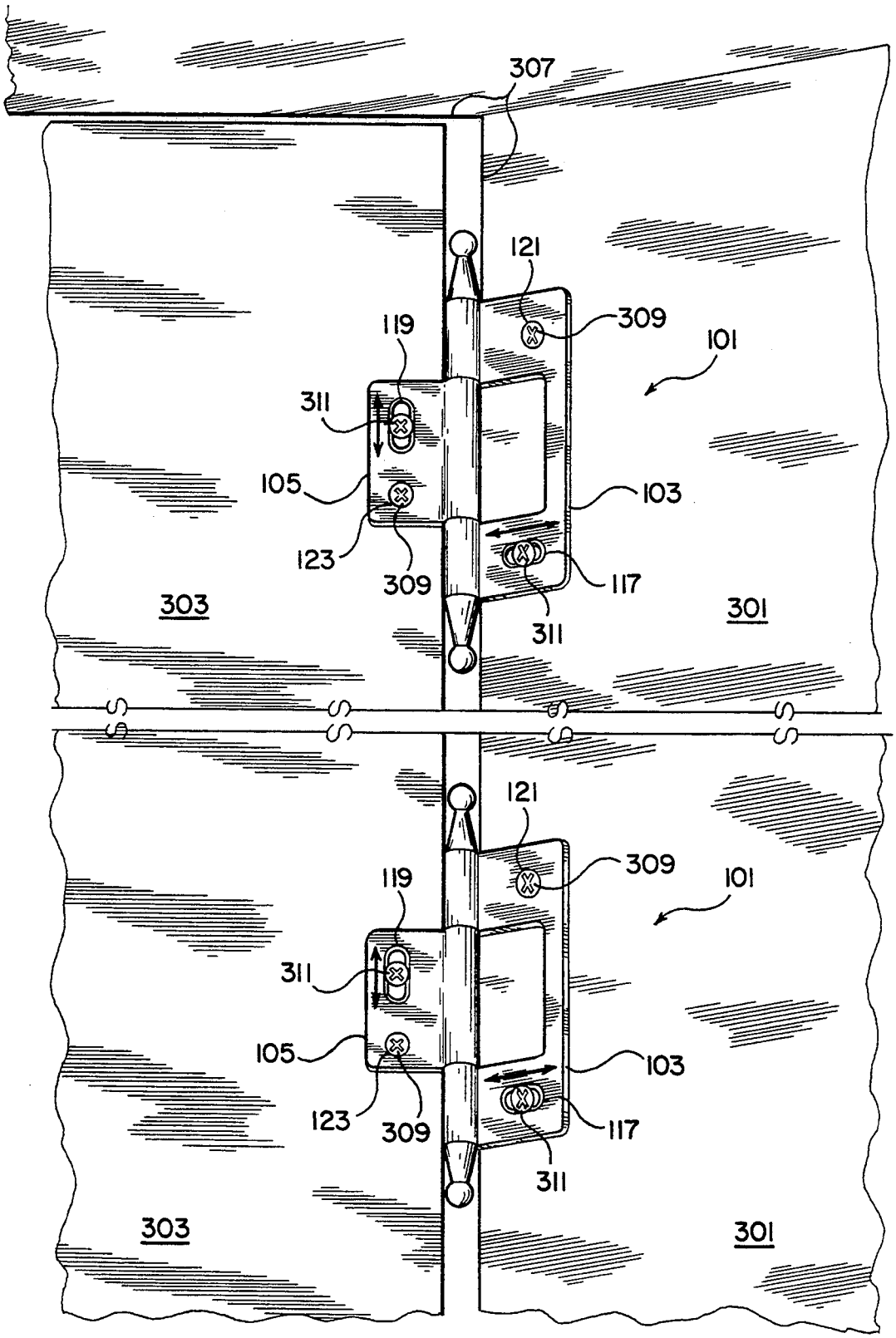
FIG. 6 is an assembly diagram of the hinge of FIG. 1 installed on an inset cabinet door.

FIG. 6 shows the hinges 101 of FIG. 1 in use on a cabinet 301 to support a door 303 inset into opening 307. Hinges 101 are attached by placing leaf surfaces **103*b*, 105*b* flush against the cabinet wall 301 and door 303 and passing mounting screws 311 through slot 117 into cabinet wall 301, and through slot 119 into door 303. Locking screws 309 pass through locking holes 121 and 123 into the wall of cabinet 301 and the door 303, respectively. Locking holes 121 and 123 serve as a fixing or locking means which permits setting the hinge 101 in a permanent position by installing locking screws 309. As can be seen from the drawing, because of the particular design of their slots and holes, hinges 101** provide a useful adjustment function without requiring protruding metal or plastic hardware that would detract from the appearance of the cabinet.

The preferred method of installation of hinge 101 is as follows: At the manufacturing site, holes will be drilled in the door 303 and the wall of cabinet 301 to receive screws 311. The hinges 101 will be installed and screws 311 will be installed, but not fully tightened. The fit of door 303 in opening 307 will then be adjusted in the vertical direction by moving the door 303 and its mounting screws 311 up or down relative to the slot 119 as indicated by the arrow on leaf 103. The fit of door 303 will be adjusted in the horizontal direction by moving the door 303 and hinge 101 in and out relative to the cabinet 301 and its mounting screws 311 in slot 117, as indicated by the arrow on leaf 105. Adjustment of the cant of door 303 is also possible since hinge 101 can be rotated slightly about the locking holes 121, 123. Hinge 101 may also be installed with slot 117 on door 303 and slot 119 on cabinet wall 301.

When door 303 fits in opening 307 satisfactorily, mounting screws 311 are tightened and the cabinet is shipped to the installation site. At the installation site, the installers check the fit of door 303 and make further adjustments if necessary to ensure that door 303 fits flush to the front of cabinet 301 and fits without binding. When the fit is satisfactory, the installer retightens mounting screws 311. The installer then drills holes in cabinet 301 and door 303 through locking holes 121 and 123 respectively to facilitate installation of locking screws 309. Locking screws 309 are then installed through holes 121 and 123 and tightened to lock the hinge in its finally adjusted position.

Thus, hinge 101 offers several advantages over non-adjustable flat hinges. Hinge 101 makes possible easy final fitting of a cabinet door to compensate for slight hole mislocations in the factory, and also to compensate for shifting of the cabinet during shipment. Hinge 101 performs this function while avoiding the increased cost, mechanical complexity, and unsightly appearance normally associated with adjustable hinges. In most cases, hinge 101 makes it unnecessary to shim the cabinet doors on site.

Most doors 303 will be mounted using two or more hinges, and sometimes four or more. When multiple hinges are used, the vertically-slotted leaves are preferably all attached to the door and the horizontally-slotted leaves will be all attached to the cabinet wall, or vice versa. The similar orientation of all hinges 101 on a given door prevents interference between the adjustment capabilities of the hinges which might otherwise occur. The utility of hinge 101 increases as the number of hinges to be mounted on a door increases, since the difficulty of properly locating the hinges increases greatly with each hinge added.

I claim:

1. An adjustable hinge for mounting inset doors, comprising:

(a) first and second hinge leaves pivotally interconnected for relative swinging movement about a pivot pin between open and closed hinge positions, said first hinge leaf being larger than said second hinge leaf and having a cut out area within its periphery for receiving said second hinge leaf therewithin to form a hinge of single leaf thickness when said hinge is in the closed position, said first hinge leaf having a pair of spaced tubular portions of complete circumference along one peripheral edge thereof, said second hinge leaf having at least one tubular portion of complete circumference along a peripheral edge thereof and positioned between and in alignment with the spaced tubular portions on said first hinge leaf for reception of said pivot pin within said aligned tubular portions:

(b) said second hinge leaf and said cut out area being substantially the same size and shape and said second hinge leaf being received within said cut out area of said first hinge leaf with the peripheral edges of said second hinge leaf closely adjacent the corresponding margins of said cut-out area, said second hinge leaf including a pair of opposite peripheral edges intersecting the tubular portion-containing peripheral edge, means for increasing the clearance between at least one of said opposite peripheral edges and said corresponding margin with increasing distance from said tubular portion-containing peripheral edge;

(c) said first hinge leaf having at least one first elongated slot passing therethrough for receiving a first mounting fastener mounting the first leaf to a first surface, said first elongated slot having a longitudinal axis in the direction of its elongation, such that the position of the first leaf can be adjusted by moving said first hinge leaf relative to said first surface, prior to final tightening of the first mounting fastener;

(d) said second hinge leaf having at least one second elongated slot passing therethrough for receiving a second mounting fastener mounting the second leaf to a second surface, said second elongated slot having a longitudinal axis in the direction of its elongation, such that the second leaf is movable relative to said second surface, prior to final tightening of said second mounting fastener;

(e) said first hinge leaf and said second hinge leaf further including first and second locking holes passing through said first hinge leaf and said second hinge leaf respectively and defining an edge around the perimeter of each locking hole, the first and second locking holes adapted to receive first and second fixing fasteners respectively, passing respectively through said first and second leaves into said first and second surfaces respectively, such that when said first fixing fastener is connected to the first surface through the first locking hole it substantially prevents movement of the first hinge leaf in the direction of the longitudinal axis of said first elongated slot by the proximity of the edge of the first locking hole to the first fixing fastener, and such that when said second fixing fastener is connected to the second surface through the second locking hole said second fixing fastener substantially prevents movement of the second hinge leaf in the direction of the longitudinal axis of said second elongated slot by the proximity of the edge of the second locking hole to said second fixing fastener.

2. The hinge of claim 1 wherein the longitudinal axes of all first elongated slots are perpendicular to the longitudinal axes of all second elongated slots.

3. The hinge of claim 2 wherein the second elongated slots are elongated in a direction that is vertical when the hinge is installed and the first elongated slots are elongated in the horizontal direction.

4. The hinge of claim 2 wherein the first hinge leaf has at least two first elongated slots and the second hinge leaf has at least two second elongated slots.

5. The hinge of claim 4 wherein the central longitudinal axes of each of said first elongated slots lie on different, parallel lines.

6. The hinge of claim 5 wherein the central longitudinal axes of each of said second elongated slots lie on different, parallel lines.

7. The hinge of claim 1 wherein the first and second elongated slots and the first and second locking holes have edges beveled to accept a flathead fastener.

8. The hinge of claim 1 wherein the first hinge leaf is connected to the second hinge leaf by a pivot pin removable to permit separation of said first and second hinge leaves.

9. The hinge of claim 1 wherein the first hinge leaf has at least two first locking holes and the second hinge leaf has at least two second locking holes.

10. The hinge of claim 1 wherein both opposite peripheral edges taper continuously from their ends adjacent the tubular portion-containing peripheral edge away from the adjacent margin of the cut out area for increasing the clearance between each said peripheral edge and said adjacent margin with increasing distance from said tubular portion-containing peripheral edge.

11. The hinge of claim 1 wherein said complete circumference tubular portions comprise tubular passageways in solid cylindrical portions.

12. The hinge of claim 1 wherein said tubular portions fit closely about said pivot pin.

13. The hinge of claim 12 wherein said tubular portion on said second hinge leaf interfits closely between said spaced tubular portions on said first hinge leaf for precluding longitudinal sliding of said tubular portion on said second hinge leaf along said pivot pin.

14. The hinge of claim 1 wherein said at least one peripheral edge tapers continuously from the tubular portion-containing peripheral edge away from the adjacent margin of the cut-out area.

15. The hinge of claim 14 wherein said at least one peripheral edge is the lower peripheral edge.

16. An inset door cabinet, comprising:

(a) a cabinet frame defining a cabinet door opening and having a hinge mounting surface along one side of the cabinet door opening;

(b) a cabinet door inset into the cabinet door opening to lie flush with the opening when said cabinet door is closed;

(c) a plurality of hinges mounted to the hinge mounting surface and the cabinet door, one of the hinge mounting surface and cabinet door being a first surface and the other being a second surface, with at least one hinge comprising:

(d) first and second hinge leaves pivotally interconnected for relative swinging movement about a pivot pin between open and closed hinge positions, said first hinge leaf being larger than said second hinge leaf and having a cut out area within its periphery for receiving said second hinge leaf therewithin to form a hinge of single leaf thickness when said hinge is in the closed position, said first hinge leaf having a pair of spaced tubular portions of complete circumference along one peripheral edge thereof, said second hinge leaf having at least one tubular portion of complete circumference along a peripheral edge thereof and positioned between and in alignment with the spaced tubular portions on said first hinge leaf for reception of said pivot pin within said aligned tubular portions;

(e) said second hinge leaf and said cut out area being substantially the same size and shape and said second hinge leaf being received within said cut out area of said first hinge leaf with the peripheral edges of said second hinge leaf closely adjacent the corresponding margins of said cut-out area, said second hinge leaf including a pair of opposite peripheral edges intersecting the tubular portion-containing peripheral edge, means for increasing the clearance between at least one of said opposite peripheral edges and said corresponding margin with increasing distance from said tubular portion-containing peripheral edge;

(f) said first hinge leaf having at least one first elongated slot passing therethrough for receiving a first mounting fastener mounting the first leaf to a first surface, said first elongated slot having a longitudinal axis in the direction of its elongation, such that the position of the first leaf can be adjusted by moving said first hinge leaf relative to said first surface, prior to final tightening of the first mounting fastener;

(g) said second hinge leaf having at least one second elongated slot passing therethrough for receiving a second mounting fastener mounting the second leaf to a second surface, said second elongated slot having a longitudinal axis in the direction of its elongation, such that the second leaf is movable relative to said second surface, prior to final tightening of said second mounting fastener;

(h) said first hinge leaf and said second hinge leaf further including first and second locking holes passing through said first hinge leaf and said second hinge leaf respectively and defining an edge around the perimeter of each locking hole, the first and second locking holes adapted to receive first and second fixing fasteners respectively, passing respectively through said first and second leaves into said first and second surfaces respectively, such that when said first fixing fastener is connected to the first surface through the first locking hole it substantially prevents movement of the first hinge leaf in the direction of the longitudinal axis of said first elongated slot by the proximity of the edge of the first locking hole to the first fixing fastener, and such that when said second fixing fastener is connected to the second surface through the second locking hole said second fixing fastener substantially prevents movement of the second leaf in the direction of the longitudinal axis of said second elongated slot by the proximity of the edge of the second locking hole to said second fixing fastener.

17. The cabinet of claim 16 wherein said tubular portions fit closely about said pivot pin and said tubular portion on said second hinge leaf interfits closely between said spaced tubular portions on said first hinge leaf for precluding longitudinal sliding of said tubular portion on said second hinge leaf along said pivot pin.

18. The cabinet of claim 16 wherein said at least one peripheral edge tapers continuously from the tubular portion-containing peripheral edge away from the adjacent margin of the cut-out area.

19. The cabinet of claim 18 wherein said at least one peripheral edge is the lower peripheral edge.

* * * * *